United States Patent [19]

Cook

[11] 4,151,825

[45] May 1, 1979

[54] COMBINATION OF ARROW HAVING NOCK MEANS AND ARROW RELEASE MECHANISM

[76] Inventor: Thomas H. Cook, 1910 Cheyenne Dr., Scottsbluff, Nebr. 69361

[21] Appl. No.: 666,484

[22] Filed: Mar. 12, 1976

[51] Int. Cl.[2] ..... F41B 5/00; F41B 5/02

[52] U.S. Cl. ..... 124/35 A; 273/106.5 C; 124/91; 124/40

[58] Field of Search ..... 124/90, 91, 23 R, 24 R, 124/86, 35 A, 40; 273/106.5 C

[56] References Cited

U.S. PATENT DOCUMENTS 2,488,597 11/1949 Konold ..... 124/35 A 2,819,707 1/1958 Kayes et al. ..... 124/35 A

*Primary Examiner*—Richard C. Pinkham

*Assistant Examiner*—William R. Browne

*Attorney, Agent, or Firm*—Roylance, Abrams, Berdo & Farley

[57] ABSTRACT

An arrow release mechanism having opposed pivotal jaws with substantially hemispherical sockets on facing sides for releasable reception of a substantially spherical arrow nock. One embodiment includes a pivotal trigger for locking and unlocking the jaws in their nock grasping position and a universally coupled handle. A second embodiment includes two linkage members for locking and unlocking the jaws.

16 Claims, 37 Drawing Figures

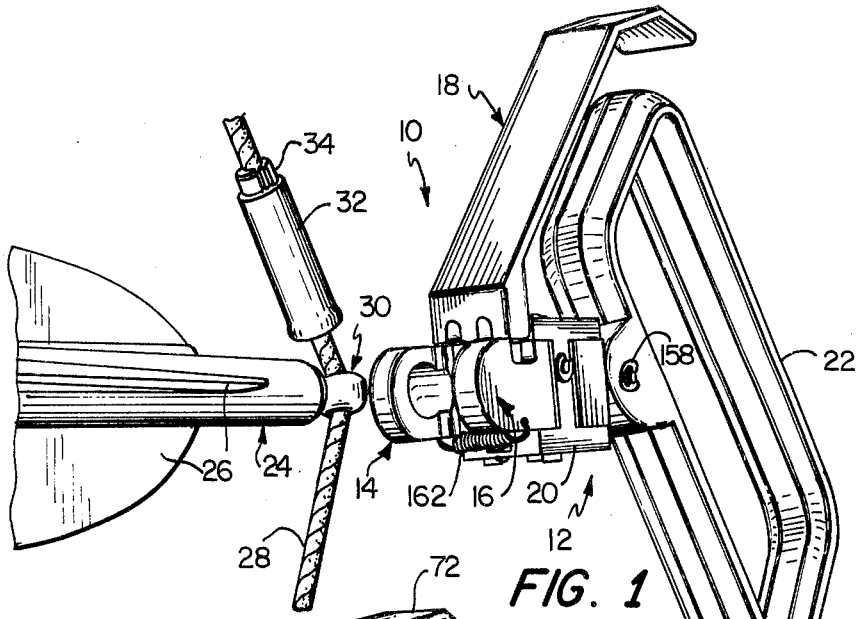
FIG. 1
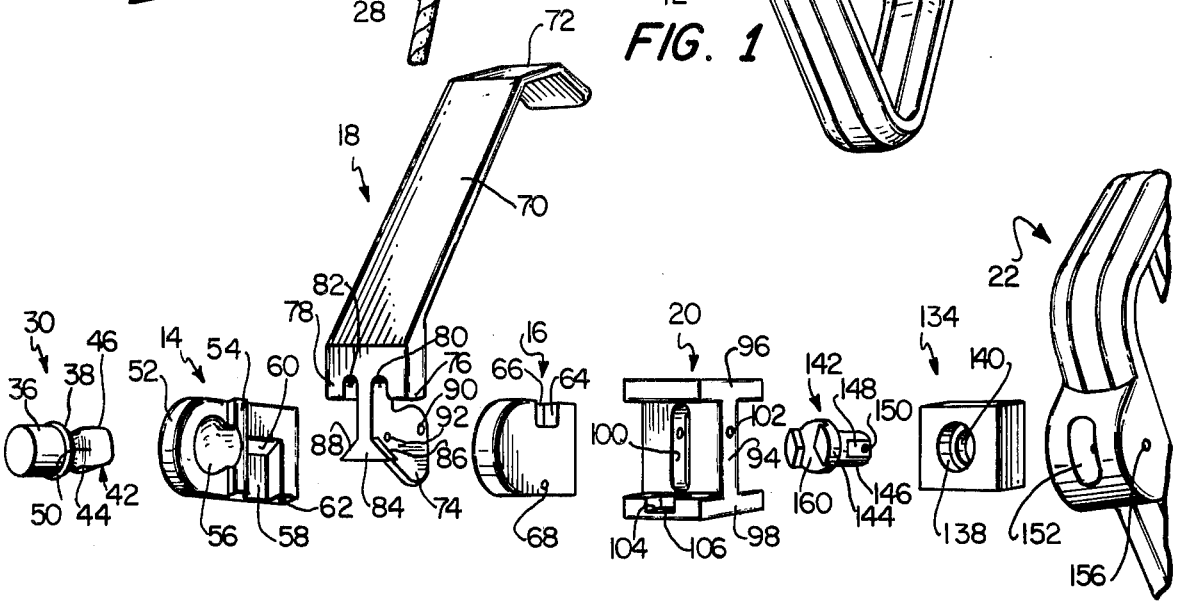
FIG. 2
FIG. 3
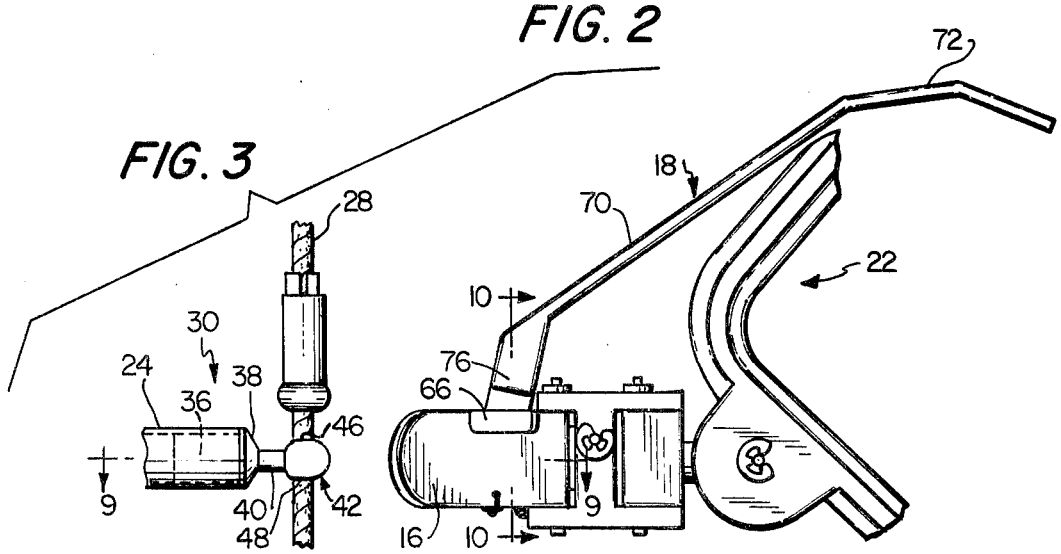

FIG. 11
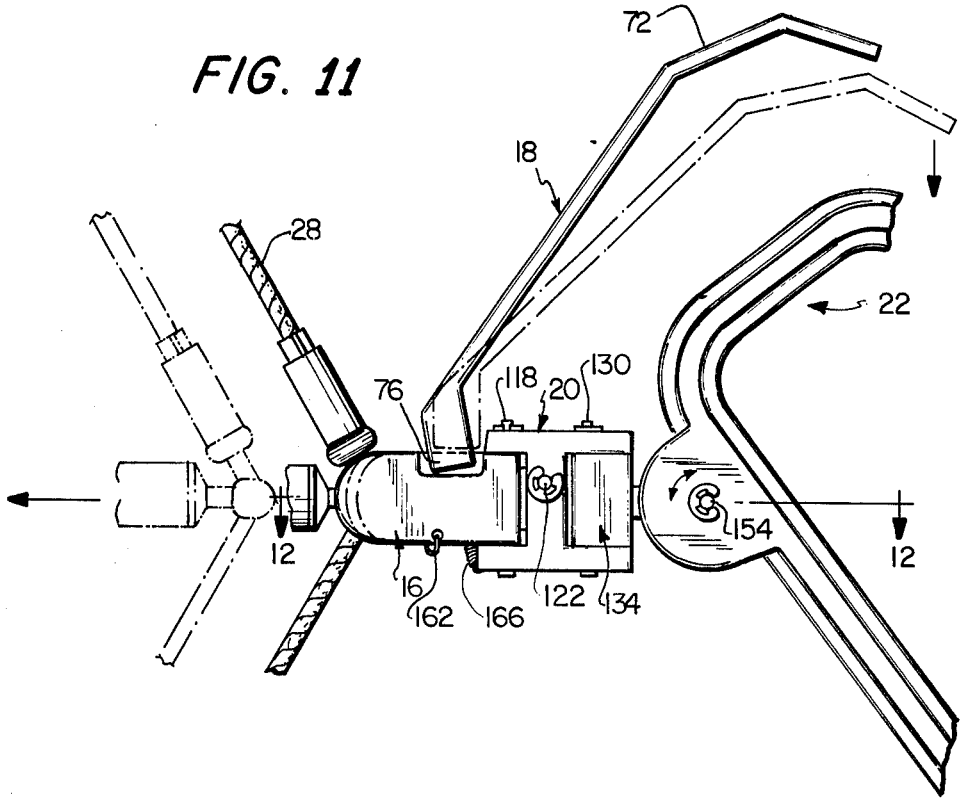
FIG. 12
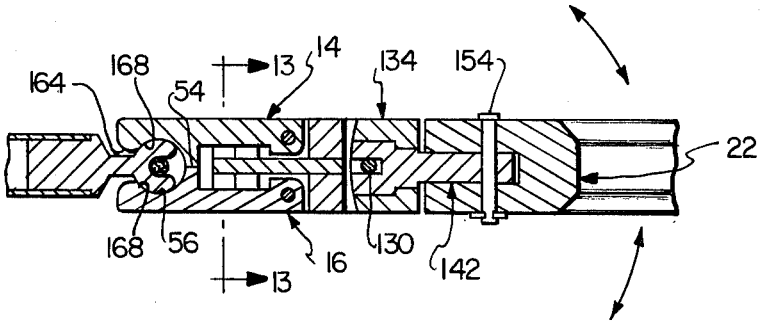
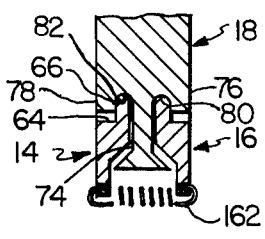
FIG. 13
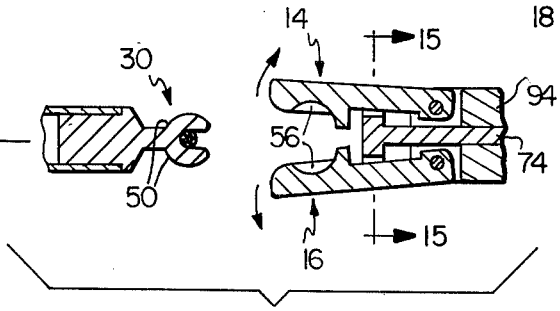
FIG. 14
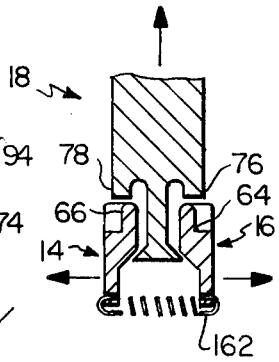
FIG. 15

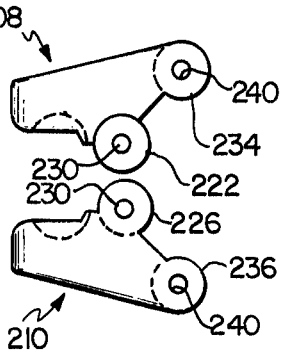
FIG. 29
FIG. 30
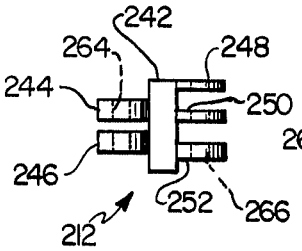
FIG. 31
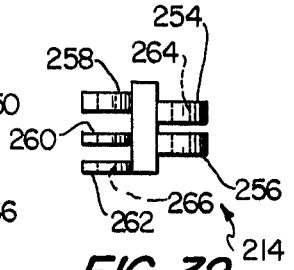
FIG. 32
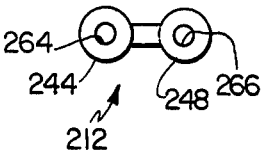
FIG. 33
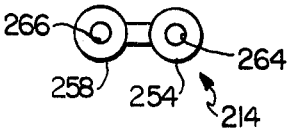
FIG. 34
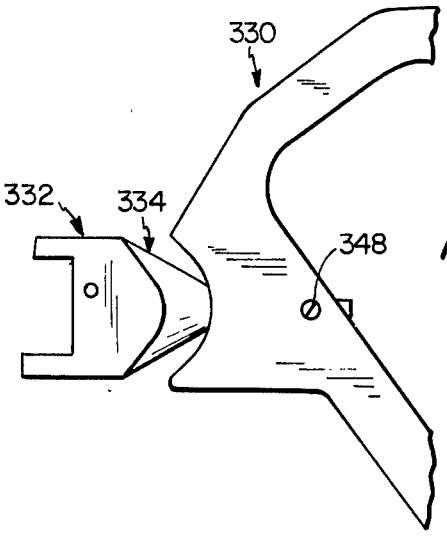
FIG. 35
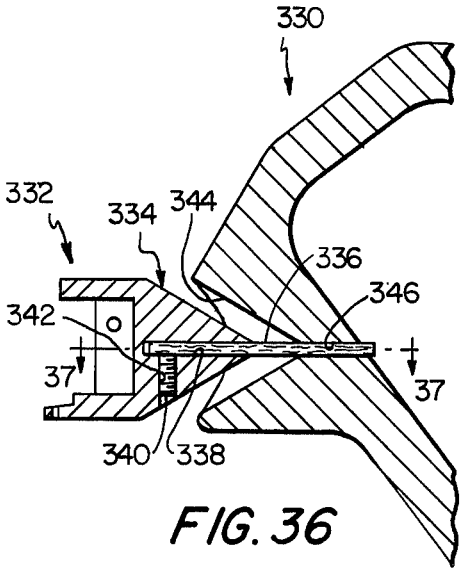
FIG. 36
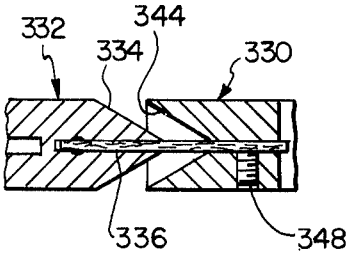
FIG. 37

COMBINATION OF ARROW HAVING NOCK MEANS AND ARROW RELEASE MECHANISM

The present invention relates to an arrow release mechanism and arrow nock therefor, and more particularly relates to a release mechanism having opposed jaws with sockets therein for releasably receiving a substantially spherical arrow nock.

Many prior art devices have been devised to mechanically grasp an arrow and bowstring combination so that the arrow can be pulled back, tensioned against the string and then mechanically released. The reason for this is the elimination of sore fingers caused by repetitive contact with a bowstring, elimination of a game scaring twang caused by fingers releasing the bowstring, and elimination of string deflection caused by fingers gripping the bowstring above and below the arrow resulting in lower arrow velocity and accuracy.

However, most of the prior art arrow release mechanisms have numerous shortcomings. For example, many directly grip the bowstring, resulting in frictional wear and ultimate destruction of the bowstring itself. Moreover, many of these devices require springs of high force which ultimately causes flinching on release of the arrow resulting in a low accuracy shot. In addition, numerous of these devices include a handle rigidly coupled to a tube into which the arrow nock is placed, thereby resulting in a somewhat rigid coupling between the arrow nock and the release mechanism. The problem with this is that any lateral movement of the device causes a corresponding lateral movement of the drawn arrow which results in a low accuracy shot. Additionally, in these prior art devices in which the arrow nock fits into a rigid tube substantially right angled stops are provided on the nock and corresponding right angle stops are provided on pivotal jaws which results in a jerking release, with corresponding lost accuracy.

Accordingly, it is an object of the present invention to overcome the limitations and drawbacks associated with the aforesaid prior art devices and to provide a new and improved arrow release mechanism and nock therefor.

Another object is to provide an arrow release mechanism which eliminates sore fingers, wear on bowstrings, and arrow twang on release.

Another object is to provide a release mechanism providing a high accuracy and high arrow velocity shot.

Another object is to provide a release mechanism which can utilize heavy draw-weight bows because the trigger mechanism does not require a strong spring.

Another object is to provide a release mechanism insuring a smooth release with no arrow deflection and no flinching by the shooter.

SUMMARY OF THE INVENTION

These objects are generally attained by providing a substantially spherical arrow nock received in substantially hemispherical recesses in the mechanism's pivotal jaws. On release of a jaw locking device, the tension of the bowstring pulls the nock from the jaws which are cammed open by the moving spherical arrow nock. This results in a very smooth, quiet release. Since the jaws grasp the nock, not the bowstring, deflection and abrasion of the bowstring are avoided. Additionally, the connection of the substantially spherical nock in the substantially hemispherical recesses provides a universal coupling therebetween, so lateral movement of the operator's hand will not cause a corresponding movement, and therefore misalignment, of the arrow received in the jaws.

More specifically, the foregoing objects are attained by providing a hand-held arrow release mechanism for use with an arrow nock having a cam surface thereon facing the tip of the arrow, the arrow nock being coupled to the arrow which is received on a bowstring, in which the combination comprises a central body member having a hand-grasping portion; a pair of opposed jaws, each having a recess on facing sides thereof, the forward portion of each recess being in the form of a cam follower surface corresponding to a part of the cam surface on the nock; means for pivotally mounting the jaws to the body member; means for biasing the opposed jaws towards each other into a grasping position in which the cam surface portion of the nock contacts the cam follower surfaces of the recesses; locking means, coupled to the central body member, for locking the jaws together in the grasping position thereby locking the nock between the jaws; and manually activated means, coupled to the locking means, for releasing the locking means thereby allowing the nock cam surface to move forward along the cam follower surfaces under the influence of the bowstring pulling on the nock so the jaws pivot outwardly of the grasping position releasing the nock and arrow therefrom.

The arrow nock cam surface is provided by forming a substantially spherical protuberance at the end of the nock with a notch therein for reception of the bowstring. Additionally, the recesses in the jaws are substantially hemispherical for reception of the substantially spherical nock protuberance and their forward portions form cam follower surfaces.

The manually activated means is a trigger pivotally coupled to the central body member and the locking means includes ears depending from the trigger and receivable in indentations formed in the jaws.

These features are illustrated in FIGS. 1–15 of the drawings. Included in these figures is a handle 22 universally coupled to a frame 20, both of these forming the central body member 12. By universally coupled it is meant that the coupling provides relative pivotal movement between the specified parts about three axes at the same time, each axis being perpendicular to the other two. In FIGS. 1–15 these three axes are represented by rod 130, swivel 142 and rod 154.

In FIGS. 16–18 a first modification of the handle-frame connection is shown. This comprises a universal coupling formed by a ball and socket.

In FIGS. 19–34, a second embodiment of the invention is shown in which the jaws are locked together by two linkage members. A universal coupling is presented between the jaws and the handle about rods 288 and 306 and swivel 278.

In FIGS. 35–37 a second modification of the handle-frame connection is shown. This comprises a universal coupling formed by a flexible cable.

Thus, since a second universal coupling is provided between the handle and the jaws (in addition to the one between the nock and the jaws), lateral movement of the operator's hand will not cause a corresponding movement, and therefore misalignment, of the arrow received in the jaws, resulting in a high accuracy release.

Other objects, advantages and salient features of the present invention will become apparent from the following detailed description, which, taken in conjunction with the annexed drawings, discloses preferred embodiments of the present invention.

DRAWINGS

Referring now to the drawings which form a part of this original disclosure:

FIG. 1 is a perspective view of the arrow release mechanism and arrow nock therefor in accordance with the present invention;

FIG. 2 is a perspective view of the various parts of the arrow release mechanism and the one piece forming the arrow nock shown in their unconnected state without the various pins and springs utilized to couple them together;

FIG. 3 is a fragmentary side elevational view of the arrow release mechanism and the arrow nock in which the jaws are in the opened position ready to receive the nock;

FIG. 11 is a fragmentary side elevational view of the arrow release mechanism and arrow nock therefor shown in solid lines in which the trigger ears lock the jaws together with the nock secured therebetween and in phantom lines in which the trigger ears no longer lock the jaws together and the arrow nock, under the influence of the bowstring, pivots the jaws open and is released therefrom;

FIG. 12 is a top plan view in section of the arrow release mechanism and arrow nock taken along lines 12—12 in FIG. 11;

FIG. 13 is a front elevational view in section showing the trigger ears locking the jaws together taken along lines 13—13 in FIG. 12;

FIG. 14 is a top plan view in section of the jaws in their releasing position with the nock moving away therefrom, such section being similar to that shown in FIG. 12;

FIG. 15 is a front elevational view in section showing the trigger ears releasing the jaws taken along lines 15—15 in FIG. 14;

FIG. 29 is a top plan view of the jaw shown in FIG. 27;

FIG. 30 is a top plan view of the jaw shown in FIG. 28;

FIG. 31 is a front elevational view of the first linkage member to be coupled to the left-hand jaw;

FIG. 32 is a front elevational view of the second linkage member to be coupled to the right-hand jaw;

FIG. 33 is a top plan view of the linkage shown in FIG. 31;

FIG. 34 is a top plan view of the linkage member shown in FIG. 32;

FIG. 35 is a fragmentary side elevational view of an arrow release mechanism having a second type of modified handle connection device comprising a cable;

FIG. 36 is a side elevational view in vertical section of the apparatus shown in FIG. 35; and FIG. 37 is a top plan view in section taken along lines 37—37 in FIG. 36.

DETAILED DESCRIPTION OF THE FIRST EMBODIMENT OF THE INVENTION

Figure 4:
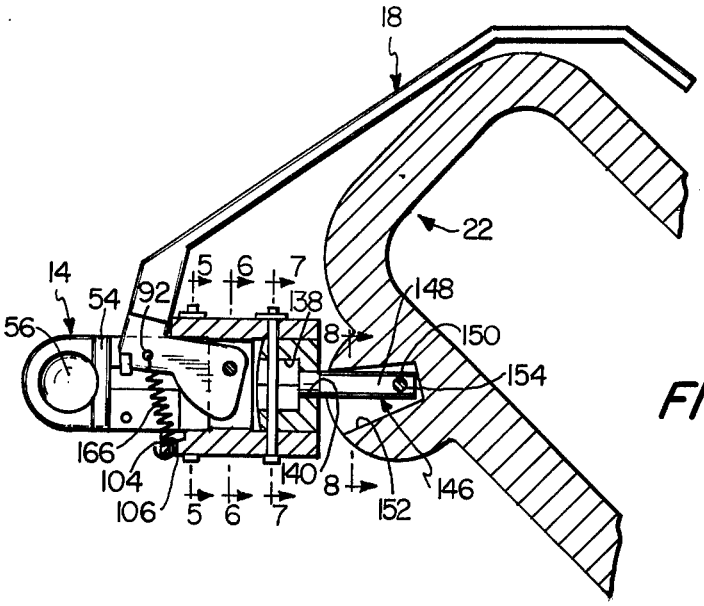
FIG. 4 is a fragmentary vertical sectional view of the arrow release mechanism shown in FIG. 3.

Referring now to the drawings in further detail, as shown in FIG. 1, the arrow release mechanism 10 comprises a central body member 12, a left-hand jaw 14, a right-hand jaw 16 and a trigger 18. The central body member 12 is comprised of a frame 20 and a handle 22.

Adjacent the arrow release mechanism is an arrow 24 having fletching 26 thereon and a nock 30 received at the butt end of the arrow and engaging the bowstring 28. Located above the nock 30 is a rubber cylinder 32 rigidly positioned on the bowstring by means of squeeze clamp 34 which helps to vertically center the release mechanism 10 relative to the bowstring.

Referring now to FIGS. 2 and 3, the nock 30 is shown comprised of a cylinder 36 received in the tubular arrow shaft 24, a cone 38 coupled to one end of the cylinder, a cylindrical extension member 40 coupled to the cone and having an outer periphery smaller than the cylinder 36, and a protuberance 42 extending from the end of the extension member 40. The protuberance has a notch 44 therein (see FIG. 9) for reception of the bowstring 28 and is substantially spherical in shape on the outer surface thereof. That is, the protuberance is basically spherical but has a somewhat flat top 46 and a flat bottom 48. The portions of the outer surface of the protuberance towards the forward end of the arrow adjacent the connection with the extension member 40 forms a cam surface 50 which is rounded. The outer periphery of the protuberance 42 is larger than the outer periphery of the extension member 40.

As shown in FIGS. 1, 2 and 3, jaws 14 and 16 are mirror images of one another, so only one will be described in detail. As seen in FIG. 2, jaw 14 is substantially rectangular having a semi-circular front 52 beveled at the edge 53. Extending outward from the surface of the inner side of jaw 14 is an abutment 54 extending from the top to the bottom of the jaw and having a flat surface. Between the front 52 and the abutment 54 is a substantially hemispherical recess 56 formed in the inner side of the jaw 14 for ultimate reception of one side of the protuberance 42. Located behind abutment 54 is a notch 58 in the inner surface of the jaw with an inclined plane 60 at the top thereof, this plane being located somewhat higher than the midpoint of the distance between the top and bottom of the jaw 14. A vertical bore 62 is formed in the rear of jaw 14 adjacent the rearmost portion of notch 58.

As most clearly shown by right-hand jaw 16 in FIG. 2, the jaws both include an upper indentation 64 formed in the top surface of each jaw. This indentation does not pass all the way through the thickness of the jaw and thereby forms a tongue 66. A horizontal bore 68 is formed in the jaw and passes through the notch 58 adjacent the bottom of the jaw.

Referring now to FIGS. 2 and 3, the trigger 18 includes an elongated member 70 with a bent upper portion 72 which can be manually manipulated and a lower pivot portion 74. Extending downwardly from the elongated member 70 are two ears 76 and 78 spaced from the pivot portion 74 to define slots 80 and 82 for the reception of tongues 66 on the jaws 14 and 16. The ears 76 and 78 are receivable in the upper indentations 64 formed in both jaws. At the front of the pivot portion 74 is a triangular wedge 84 having two inclined surfaces defining cams 86 and 88 for interaction with cam following inclined planes 60 located in each jaw 14 and 16. Also provided in the pivot portion 74 are two horizontal bores 90 and 92.

Figure 5:
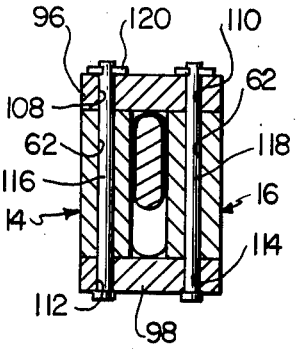
FIG. 5 is a front elevational view in section taken along lines 5—5 in FIG. 4.

As best shown in FIG. 2, the frame 20 is I-shaped and has a vertical centerpiece 94, a top piece 96 and a bottom piece 98. A vertically extending aperture 100 is formed in the center of the centerpiece 94 and extends substantially completely between the top and bottom pieces 96 and 98. A transverse bore 102 extends across the centerpiece 94 somewhat above the midportion thereof. As best seen in FIGS. 2 and 4, the top of the bottom piece 98 at the forward end thereof has a slanted notch 104 formed therein with a vertical bore 106 passing through the bottom piece 98 at the bottom of the slanted notch 104. As best seen in FIGS. 4 and 5, vertical bores 108, 110, 112 and 114 are formed in the front portions of top piece 96 and bottom piece 98 for the reception of rods 116 and 118. These rods are secured by snap rings 120.

As seen in FIG. 5, rods 116 and 118 pass through vertical bores 62 in the jaws 14 and 16 thereby pivotally mounting the jaws to frame 20.

Figure 6:
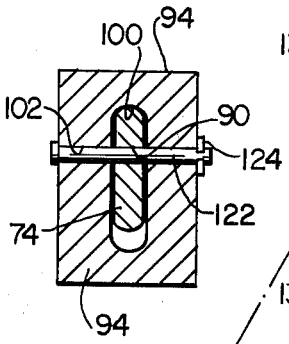
FIG. 6 is a front elevational view in section taken along lines 6—6 in FIG. 4.

As shown in FIG. 6, horizontal rod 122 passes through transverse bore 102 in the centerpiece 94 of frame 20 and also passes through bore 90 in pivot portion 74 of trigger 18 received in aperture 100 to pivotally mount the trigger to the frame 20. Rod 122 is secured by a snap ring 124.

Figure 7:
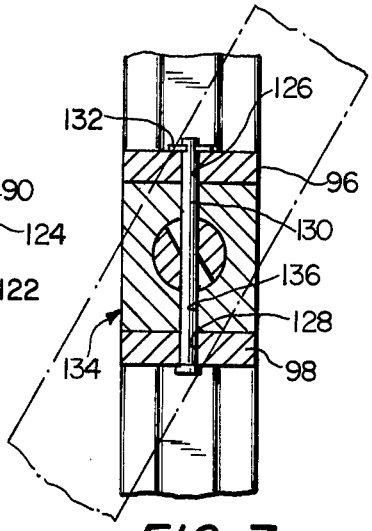
FIG. 7 is a front elevational view in section taken along lines 7—7 in FIG. 4.
Figure 8:
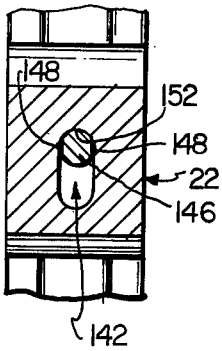
FIG. 8 is a front elevational view in section taken along lines 8—8 in FIG. 4.

As best shown in FIGS. 4 and 7, vertical bores 126 and 128 are formed in the rear portions of the top piece 96 and the bottom piece 98 for the reception of a vertical rod 130 which is secured by snap ring 132.

Referring to FIGS. 2, 4 and 7, a substantially cube-shaped yoke 134 is positioned between the rear portions of the top piece 96 and the bottom piece 98 of the frame and is pivotally mounted for pivotal movement about rod 130 via vertical bore 136 therein, such movement being limited by contact of yoke 134 with centerpiece 94. Formed in substantially the middle of the yoke 134 is a first horizontal cylindrical bore 138 and then communicating therewith and extending through to the rear of the yoke is a second horizontal cylindrical bore 140 having a diameter smaller than the first bore.

As shown in FIGS. 2, 4, 7 and 8, a swivel 142 is received in the cylindrical bores of yoke 134. The swivel 142 includes a cylindrical forward portion 144 received in the first cylindrical bore 138 and a substantially cylindrical rear portion 146 extending through cylindrical bore 140 and into handle 22. The rear portion 146 has flat surfaces 148 formed on opposite sides thereof and a transverse aperture 150 near the end thereof.

As best seen in FIG. 4, the rear portion 146 of the swivel 142 is received in a blind cut-out 152 in handle 22 and is pivotally supported therein via rod 154 passing through bore 156, shown in FIG. 2, and secured by a snap ring 158 shown in FIG. 1. Thus, the handle 22 is capable of pivotal movement about horizontal rod 154, such movement limited by contact of swivel 142 with the inner surface of cut-out 152.

As best seen in FIGS. 2, 4 and 7, the forward portion 144 on swivel 142 has a substantially X-shaped cut-out 160 which receives vertical rod 130 passing through the yoke 134. Thus, swivel 142 and handle 22 can pivot limitedly about the longitudinal horizontal axis of swivel 142 by means of the reception of rod 130 in the X-shaped cut-out 160. As shown in FIG. 7, handle 22 can pivot clockwise from a vertical position shown in solid lines to an off-set position shown in phantom lines. This is for a right-handed archer. If a left-handed archer is to use the mechanism, a mirror image of swivel 142 is used.

Referring now to FIGS. 1 and 4, a spring 162 is shown coupled between jaws 14 and 16 by means of retainment in each via horizontal bores 68. This spring 162 biases the jaws 14 and 16 together until they have their abutments 54 contacting one another, as shown in FIG. 12. It should also be noted in FIG. 12 that these abutments 54 place the jaws 14 and 16 in the grasping position, in parallel relationship with a slot 164 formed therebetween adjacent recesses 56 in each. The purpose of this slot 164 is to allow the bowstring 28 to pass between the closed jaws.

As best seen in FIG. 4, a second spring 166 is coupled between bore 92 in pivot portion 74 of trigger 18 and bore 106 in the slanted notch 104 of frame bottom piece 98. This second spring 166 tends to urge the front of trigger 18 downwardly as viewed in FIG. 4.

OPERATION OF THE FIRST EMBODIMENT

Figure 9:
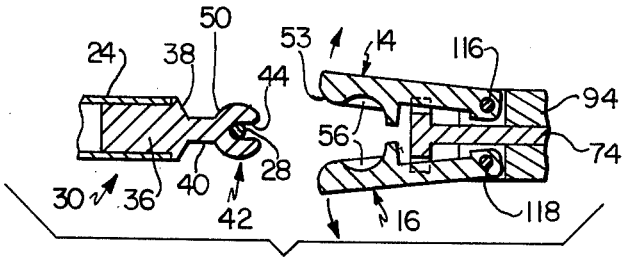
FIG. 9 is a fragmentary top plan view in section taken along lines 9—9 in FIG. 3.
Figure 10:
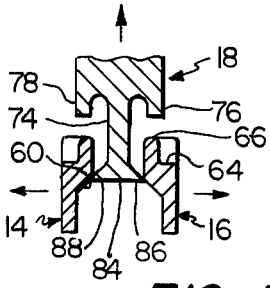
FIG. 10 is a front elevational view in section taken along lines 10—10 in FIG. 3.

Turning now to FIGS. 3, 9 and 10, the arrow release mechanism 10 is shown in the position for receiving the arrow 24 and its associated nock 30 which is received on the bowstring 28. Thus, by using his thumb, trigger 18 has been depressed angularly at its upper portion 72 by the operator of the device whose hand is securely grasped around handle 22. With the other hand grasping the bow and maintaining the forward portion of the arrow against the bow, the release mechanism 10 is maneuvered so that nock 30 is between the recesses 56 of the now spread apart jaws 14 and 16. These jaws are easily spread apart by means of the upward movement of cams 86 and 88 on the pivot portion 74 of trigger 18, which cams act against inclined planes 60 on the inside surfaces of jaws 14 and 16. As long as the trigger 18 is pivoted clockwise as shown in FIG. 3, the jaws will remain open.

Once the nock 30 is between jaw recesses 56, the trigger 18 is released which causes two things. First, under the influence of spring 166, as shown in FIG. 4, the trigger 18 pivots counterclockwise as shown in FIGS. 3 and 4 and the cams 86 and 88 slide down the inclined planes 60. This allows the second thing to happen which is the moving together of the opposed jaws under the influence of spring 162 shown in FIG. 1.

This closed or grasping position in which the recesses 56 grasp the nock 30 is shown in FIG. 12. Additionally, as shown in FIGS. 11 (solid lines) and 13, the downward force of spring 166 causes the ears 76 and 78 on trigger 18 to be received in upper indentations 64 on both of the jaws 14 and 16. Since in addition to this the tongues 66 on the jaws are received in slots 80 and 82 between the ears 76 and 78 and pivot portion 74 of the trigger, the jaws are locked together, cannot be pulled apart, and securely receive protuberance 42 on nock 30.

The operator of the release mechanism now draws the mechanism, which is locked to the arrow via nock 30, back to the firing position and takes aim. It should be noted that handle 22 is universally coupled to frame 20 along rod 154, swivel 142 and rod 130 and that spherical nock 30 is universally coupled to jaw recesses 56 so that any movement of the shooter's hand will not change the aim of the arrow.

In order to release the arrow from the mechanism 10, the shooter depresses trigger 18 on bent upper portion 72. When the trigger ears 76 and 78 pass upwards just above tongues 66 on jaws 14 and 16, as shown in FIG. 15, the jaws 14 and 16 can pivot open by means of the force exerted by the bowstring in pulling on the nock 30.

This is accomplished smoothly since the cam surface 50 on the nock 30 corresponds to the forward portions of recesses 56 which form corresponding cam follower surfaces 168 as shown in FIG. 12. Thus, the moving nock 30 cams open the jaws 14 and 16 against the action of spring 162 and is released, as shown in FIGS. 11 and 14.

Since the cam surface 50 on the front of nock 30 corresponds to the cam follower surfaces 168 on the forward portions of the recesses 56, the release of the arrow is smooth and no non-symmetrical forces are involved.

Once the nock leaves the jaws, spring 162 pulls the jaws together and the jaws of the release mechanism 10 can be reopened by again depressing the trigger to receive another arrow and nock.

FIRST MODIFIED HANDLE AND FRAME CONNECTION

Figure 16:
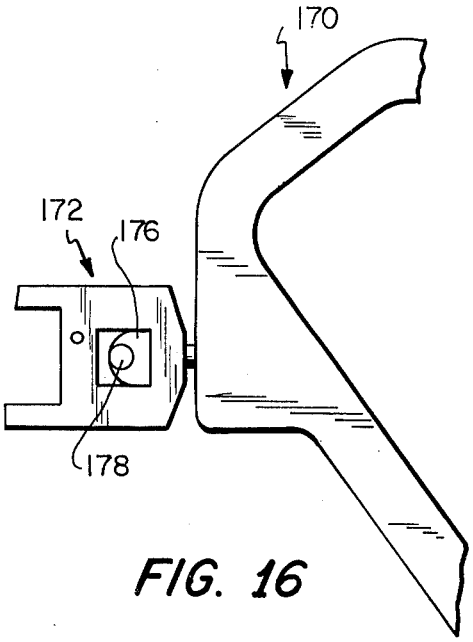
FIG. 16 is a fragmentary side elevational view of an arrow release mechanism having a modified handle connection device comprising a ball and socket.
Figure 17:
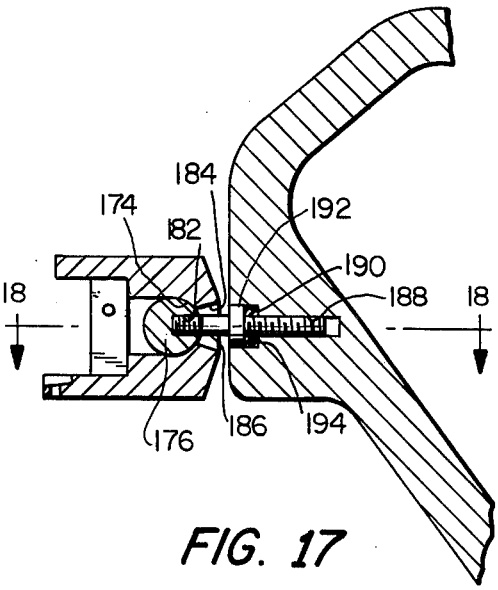
FIG. 17 is a side elevational view in vertical section of the apparatus shown in FIG. 16.
Figure 18:
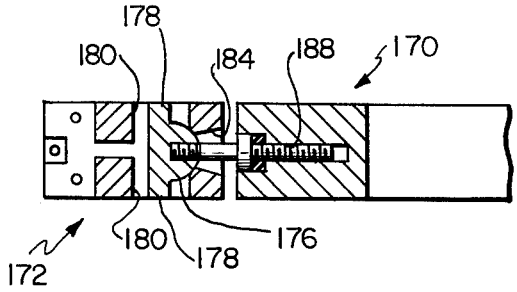
FIG. 18 is a top plan view in section taken along lines 18—18 in FIG. 17.

Referring now to FIGS. 16, 17, and 18, a modified arrangement is shown for universally coupling a handle 170 to a frame 172 for use in the present invention. That part of the apparatus previously described regarding the jaws and the trigger is the same; however, the yoke 134 and swivel 142 are eliminated and the frame is modified.

Thus, as shown in FIGS. 16, 17 and 18, the rear portion of frame 172 includes a socket 174 for the reception of a ball 176. This ball has side horns 178 extending into rectangular cut-outs 180 on both sides of the frame 172.

The ball 176 also has an internal threaded bore 182 for the reception through rear bore 184 in frame 172 of threaded bolt 186. The other end of bolt 186 is threaded and is received in correspondingly threaded blind bore 188 in handle 170. Additionally, a larger blind bore 190 near the surface of the handle 170 and concentric with bore 188 receives a cylindrical head 192 on the threaded bolt 186 as well as a washer 194.

Thus, a second embodiment of a universal coupling of the handle to the frame in the present invention is shown, with the limitations on movement of the handle relative to the frame being presented by contacting portions of the handle and frame after relative movement therebetween.

SECOND EMBODIMENT

As shown in FIGS. 19–34, a second embodiment of the overall invention is illustrated in which the jaws for receiving the nock 30 are pivotable by means of moving various linkage members. The advantages of the embodiment described above are also contained in this second embodiment and moreover fewer parts are necessary to form this second embodiment.

Figure 19:
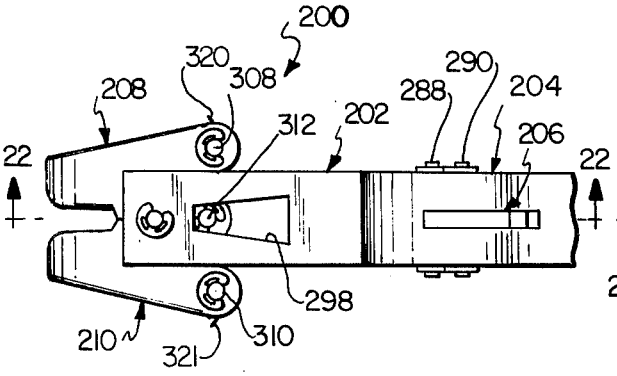
FIG. 19 is a fragmentary top plan view of an arrow release mechanism in accordance with the present invention in the form of a modified embodiment in which a series of linkage members are utilized to lock and unlock the jaws.
Figure 20:
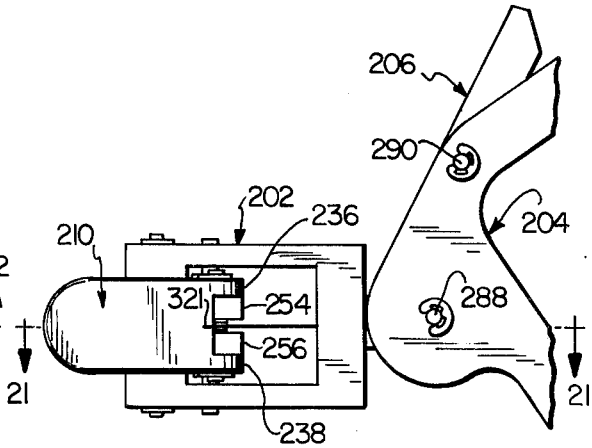
FIG. 20 is a fragmentary side elevational view of the mechanism shown in FIG. 19.
Figure 21:
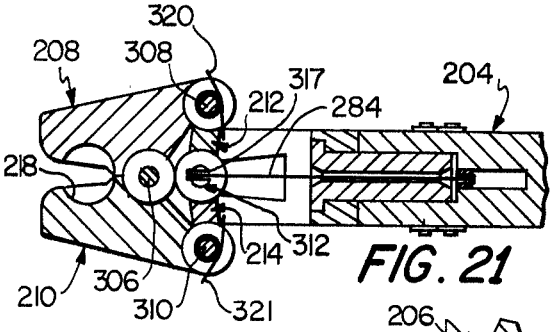
FIG. 21 is a top plan view in section taken along lines 21—21 in FIG. 20.
Figure 23:
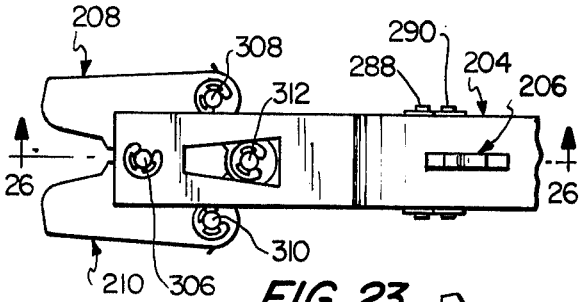
FIG. 23 is a fragmentary top plan view of the modified mechanism shown in FIG. 19 in which the jaws are in the open position.

Referring to FIGS. 19, 20 and 21, the modified arrow release mechanism 200 is comprised of a frame 202, a handle 204, a trigger 206, a left-hand jaw 208, a right-hand jaw 210, a first linkage member 212 and a second linkage member 214.

As seen in FIGS. 27, 28, 29 and 30, which show jaws 208 and 210, each jaw is substantially triangular in plan view with a front semi-circular edge 216 with a bevel 217 and a recess 218, the same as recess 56 described above for the first embodiment. Similarly abutment 220 is provided, similar to abutment 54 described above.

Centrally located of the jaw and to the rear of abutment 220 are two spaced central lugs 222 and 224 on jaw 208 and 226 and 228 on jaw 210. These lugs have longitudinal bores 230 therein. Additionally, spaced rear lugs 232 and 234 are located at the rear of jaw 208 and rear lugs 236 and 238 are located on the rear of jaw 210. Each of these rear lugs has a longitudinal bore 240.

Referring to FIGS. 31 and 33, the first linkage member 212 is comprised of a body member 242, two outer lugs 244 and 246 coupled to one side of the body member and spaced apart, and three inner lugs 248, 250 and 252 which are coupled on the opposite side of body member 242 and are spaced from each other.

Outer lugs 244 and 246 are substantially midway between the top and bottom of body member 242 while inner lug 248 is at the top of body member 242.

As shown in FIGS. 32 and 34, the second linkage member 214 is exactly the same as the first linkage member 212, but is upside down. Thus, the second linkage member includes outer lugs 254 and 256 and inner lugs 258, 260 and 262.

The inner lugs on both of the linkage members will be interleaved and so the distance between inner lugs 248 and 250 is substantially equal to the thickness of inner lug 258 and the distance between inner lugs 260 and 262 is substantially equal to the thickness of inner lug 252.

The outer lugs on both linkage members have longitudinal bores 264 and the inner lugs have longitudinal bores 266.

Figure 22:
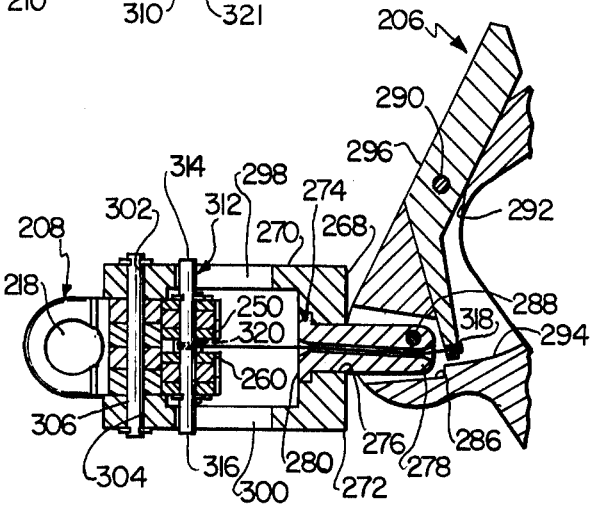
FIG. 22 is a fragmentary side elevational view in vertical section taken along lines 22—22 in FIG. 19.
Figure 24:
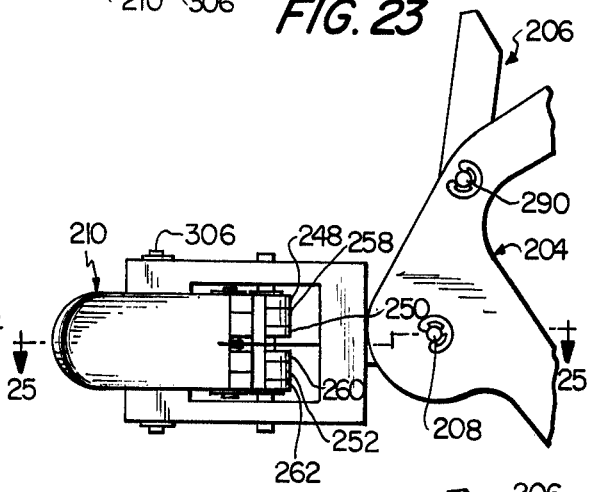
FIG. 24 is a fragmentary side elevational view of the mechanism shown in FIG. 23.
Figure 25:
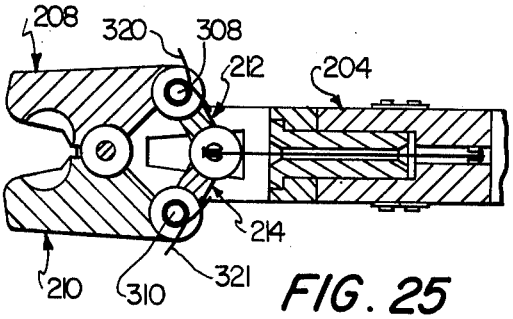
FIG. 25 is a top plan view in section taken along lines 25—25 in FIG. 24.
Figure 26:
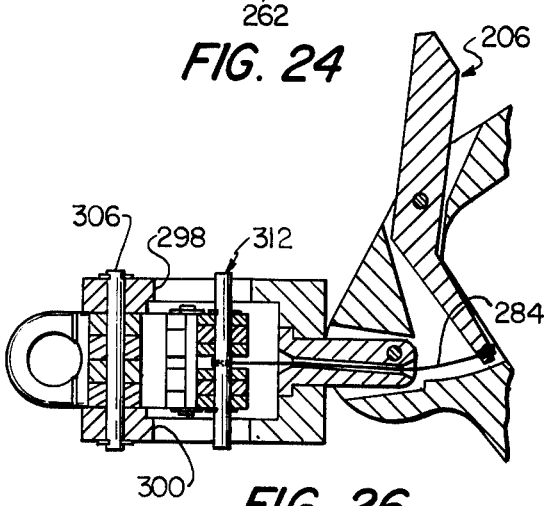
FIG. 26 is a side elevational view in vertical section taken along lines 26—26 in FIG. 23.
Figure 27:
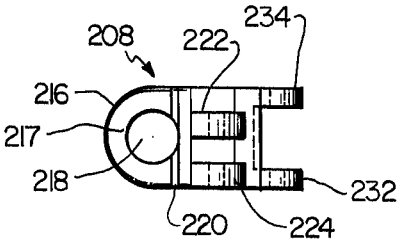
FIG. 27 is a side elevational view of the left-hand jaw utilized in the modified mechanism shown in FIG. 19.
Figure 28:
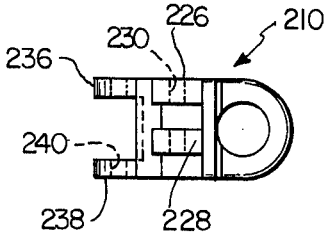
FIG. 28 is a side elevational view of the right-hand jaw shown in FIG. 19.

Referring now to FIGS. 19 and 22, the frame 202 is substantially U-shaped and comprises a rear wall 268, a top wall 270 and a bottom wall 272. The rear wall 268 has concentric centrally located bores 274 and 276 with bore 274 being larger than bore 276 and on the forward part of rear wall 268. Received in these bores is a substantially cylindrical swivel 278 having a lip 280 received in bore 274, this swivel 278 having a central bore 282 for the reception of a cable 284.

The rear end of swivel 278 fits into a cut-out 286 in handle 204 where it is pivotally coupled to the handle via rod 288 passing through a suitable bore therein in the handle 204.

Pivotally coupled via rod 290 to the handle 204 is trigger 206 which is received in passage 292 in the handle 204. Passage 292 has a rear opening 294 in the handle and a top opening 296 therein.

As best seen in FIGS. 19, 21 and 22, cut-outs 298 and 300 are formed respectively in the top wall 270 and the bottom wall 272 of frame 202, these cut-outs being in the form of a trapezoid.

Referring now to FIGS. 19, 20, 21 and 22, in assembling the arrow release mechanism 200, central lugs 222 and 224 of left-hand jaw 208 are interleaved with central lugs 226 and 228 of right-hand jaw 210 with the bores 230 therein aligned with each other and with bores 302 and 304 (FIG. 22) centrally located on top wall 270 and bottom wall 272 of the frame 202 and rod 306 is maneuvered through all of these bores and secured by suitable snap rings. Thus, rod 306 forms a vertical pivot axis for jaws 208 and 210.

In addition rear lugs 232 and 234 of jaw 209 receive therebetween outer lugs 244 and 246 of the first linkage member 212 with rod 308 passing through the central bores in these lugs and secured by suitable snap rings. Similarly, rear lugs 236 and 238 of jaw 210 are aligned with outer lugs 254 and 256 on the second linkage member 214 and rod 310 is passed through the longitudinal bores therein and secured by suitable snap rings.

Thus, the first linkage member 212 is pivotally coupled to jaw 208 and the second linkage member 214 is pivotally coupled to jaw 210.

Additionally, the inner lugs on the first and second linkage members are interleaved with rod 312 passing through the longitudinal bores therein and secured adjacent inner lug 248 and inner lug 262 by means of suitable snap rings shown in FIG. 22. As shown therein, the ends 314 and 316 of rod 312 extend through cut-outs 298 and 300 and above and below the top wall 270 and bottom wall 272.

As shown in FIGS. 21 and 22, cable 284 is suitably secured in an aperture 317 in the center of rod 312 in the space between lugs 250 and 260. Additionally, the other end of cable 284 is suitably secured in an aperture 318 at the bottom of trigger 206. These apertures 317 and 318 are of larger diameter than cable 284 allowing use of a stiff cable with enlarged ends.

As best seen in FIG. 21, a first torsional spring 320 is wrapped around rod 308 between lugs 244 and 246 and contacts the outer rear portion of jaw 208 and the outer rear portion of the first linkage member 212. Similarly, a second torsional spring 321 is wrapped around rod 310 between lugs 254 and 256 and contacts the outer rear portion of jaw 210 and the outer rear portion of the second linkage member 214. These two torsional springs urge rod 312 towards rod 306 with sufficient force to normally keep jaws 208 and 210 closed.

As shown in FIGS. 19–22, the jaws 208 and 210 are in this closed position and, while not shown for reasons of clarity, can receive a nock 30 described above in recesses 218.

This nock is received between the jaws, and the jaws are locked, in view of the linkage system coupling the jaws. That is, as seen in FIG. 21, the distance between rods 308 to 310 is smaller than the sum of the distances between rods 308 to 312 and 312 to 310 with the jaws in the grasping position. Thus, with the lugs surrounding rod 306 contacting the lugs surrounding rod 312 and with the center of rod 312 being forward of a plane cutting through the center of rods 308 and 310, any forces pulling a nock received in recesses 218 to the left as viewed in FIG. 21 will cause the jaws to remain closed, rather than to open. Thus, the nock is very securely received between the pivotable jaws. In addition, the mechanism 200 can be placed in a jaw-locking position with rods 308, 310 and 312 located in a common plane as long as the diameters of the lugs surrounding rod 306 and rod 312 are increased slightly from those shown in FIG. 21. This occurs since springs 320 and 321 have sufficient force, when the mechanical advantage of the various lever arms involved are considered, to keep the jaws closed against the bowstring force exerted on the nock. In this situation the distance between rods 308 to 310 is the same as the sum of the distances between rods 308 to 312 and 312 to 310 with the jaws in the grasping position. The result is a trigger actuation needing less activating force.

In order to release an arrow, the top of trigger 206 is pushed to the left as viewed in FIGS. 20 and 22 so that it pivots counterclockwise about rod 290 causing the bottom portion thereof to pull on cable 284 and move it to the right as shown in FIG. 22. This causes the rod 312 and linkage members 212 and 214 to move rearwardly of the release mechanism 200 toward a position shown in FIGS. 23–26. As this movement occurs, rod 312 passes rearward through the plane containing rods 308 and 310 unlocking the jaws and allowing nock 30 to move forward under the tension of the bowstring. At this time, a camming action is exerted by the cam surface 50 on the nock 30, as previously described, on the cam follower surfaces formed in recesses 218 which are the same as the surfaces formed in recesses 56 described above. Thus, the arrow is smoothly released from the jaws.

If the operator continues to push trigger 206 counterclockwise, the mechanism's parts come to rest in the open position shown in FIGS. 23–26. As long as the trigger is held in the FIG. 26 position, the jaws remain open for the reception of a new arrow nock.

In order to return the jaws to the closed position shown in FIGS. 19 and 21, with a nock having been placed therebetween, the operator of the mechanism merely relaxes the forward thumb force on trigger 206 and torsional springs 320 and 321 urge rod 312 towards rod 306, thus closing and locking the jaws upon the nock.

Although the protruding ends 314 and 316 of rod 312 offer a manual override for closing or opening the jaws (if the mechanism were jammed) and although either protruding end 314 or 316 could provide a trigger connection for some modified design, the main reason for the trapezoid cut-outs and the protruding rod ends is one of safety. The trapezoid cut-outs 298 and 300 allow horizontal lateral movements of rod 312 of only 6° to the left and 6° to the right. If these trapezoid cut-outs were absent and rod 312 shortened on both ends, the combination of closed jaws 208 and 210 and linkage members 212 and 214 could rotate about rod 306, the rotation being restricted only by cable 284. This rotation about rod 306 could continue until cable 284, of fixed length, would cause a rearward movement of rod 312 which would result in an unexpected and unwanted opening of the jaws even though the trigger had not been manually pushed forward at its upper arm. Thus after 6° movement to the left or right by rod 312, the sides of the cut-outs prevent further movement and accidental jaw release.

SECOND MODIFIED HANDLE AND FRAME CONNECTION

Referring now to FIGS. 35–37, a second modified arrangement is shown for universally coupling a handle 330 to a frame 332 for use in the present invention. That part of the apparatus previously described concerning FIGS. 1–15 and regarding the jaws and trigger is the same except the yoke 134 and swivel 142 are eliminated and the frame is modified.

Thus, as shown in FIGS. 35, 36 and 37, the rear portion of frame 332 includes a conical member 334 receiving one end of a flexible, metal or synthetic material cable 336 in a central blind bore 338. A set screw 340, received in threaded bore 342 at right angles to bore 338, secures cable 336 to frame 332.

Handle 330 has a conical indentation 344 facing conical member 334 with a bore 346 at the apex thereof which receives the other end of cable 336. This end is secured to the handle 330 via set screw 348, shown in FIG. 37.

The length of cable 336 is chosen long enough so, when the cable is extended to its maximum length, the apexes of conical member 334 and conical indentation 344 are spaced as shown in FIGS. 36 and 37. Thus, the conical surfaces associated therewith are spaced allowing universal movement between the frame 332 and handle 330. Additionally, the frame and handle can initially be positioned in different planes if this is preferred by the operator's shooting style.

The limitations on handle-frame relative movement are presented by the contacting of the conical members outer surface with the surface of the conical indentation.

While various advantageous embodiments of the present invention have been chosen to illustrate this invention, it will be understood by those skilled in the art that various changes and modifications can be made therein without departing from the scope of the invention as defined in the appended claims.

What is claimed is:

1. A hand-held arrow release mechanism and an arrow having an arrow nock coupled thereto which nock is received on a bowstring, the combination comprising:

an arrow having an arrow nock coupled thereto, said nock having a cam surface thereon which cam surface faces the forward tip of said arrow, diverges outwardly from the longitudinal axis of said arrow and extends rearwardly of said arrow along the longitudinal axis thereof; and a release mechanism comprising a central body member having a hand grasping portion;

a pair of opposed jaws, each having a recess on facing sides thereof, the forward portion of each recess being in the form of a cam follower surface corresponding to part of said cam surface on said nock;

means for pivotally mounting said jaws to said body member;

means for biasing said opposed jaws toward each other into a grasping position in which said cam surface portion of said nock contacts said cam follower surfaces of the recesses;

locking means for locking said jaws together in the grasping position thereby locking said nock between said jaws; and manually activated means, coupled to said locking means, for releasing said locking means thereby allowing said nock cam surface to move forward along said cam follower surfaces under the influence of the bowstring pulling on said nock so said jaws are pivoted outwardly of the grasping position by the moving nock cam surface, thereby releasing said nock and arrow therefrom.

2. The combination according to claim 1, wherein each of said recesses is substantially hemispherical in shape.

3. The combination according to claim 1, wherein each of said jaws includes an indentation, said manually activated means includes a trigger pivotally coupled to said central body member, and said locking means includes two ears extending from said trigger for releasable engagement with said indentations.

4. The combination according to claim 1, and further including means, coupled to said body member, for moving said jaws open to readily receive the nock therebetween.

5. The combination according to claim 4, wherein said manually activated means includes a trigger pivotally coupled to said central body member and said means for moving comprises a cam coupled to said trigger and a cam follower formed on each of said jaws.

6. The combination according to claim 1, wherein said central body member includes means for universally coupling said hand-grasping portion thereto.

7. A release mechanism according to claim 6, wherein said means for universally coupling comprises a socket formed in said central body member and a ball receivable in said socket and coupled to said hand-grasping portion.

8. A release mechanism according to claim 6, wherein said means for universally coupling comprises a flexible cable coupled at one end to said central body member and at the other end to said hand-grasping portion.

9. A release mechanism according to claim 6, wherein said means for universally coupling comprises a yoke pivotally coupled to said body member for pivotal movement about a vertical axis, and a swivel rod pivotally received at one end in said yoke for pivotal movement about a first horizontal axis and pivotally received at the other end in said hand-grasping portion for pivotal movement about a second horizontal axis perpendicular to said first horizontal axis.

10. A release mechanism according to claim 1, wherein each of said jaws includes a plurality of central lugs each having a central lug bore therein, and said means for pivotally mounting comprises a rod coupled to said body member and passing through said lug bores.

11. A release mechanism according to claim 1, wherein said locking means comprises a first linkage member, first pivot means for pivotally coupling one end of said first linkage member to an end of a first of said jaws, a second linkage member, second pivot means for pivotally coupling one end of said second linkage member to an end of the second of said jaws, third pivot means for pivotally coupling the other ends of said first and second linkages together, the distance between said first and second pivot means, when said jaws are in the grasping position, being not greater than the sum of the distances between said first pivot means and said third pivot means, and said second pivot means and said third pivot means.

12. A release mechanism according to claim 11, wherein said manually activated means comprises a trigger pivotally coupled to said central body member and cable means for connecting said trigger and said third pivot means.

13. The combination according to claim 1, wherein said jaws include abutment means, protruding inwardly from adjacent faces of said jaws adjacent said recesses, for establishing a minimum spacing between said jaws in said grasping position.

14. The combination according to claim 1, wherein the forward portion of each of said recesses is spaced inwardly from the forward edge of the jaw in which said recess is formed and is outwardly diverging from the longitudinal axis of said mechanism and rearwardly extending along such longitudinal axis.

15. A hand-held arrow release mechanism for use with an arrow nock releasably received in the release mechanism, the arrow nock being coupled to an arrow received on a bowstring, the combination comprising:

an arrow having an arrow nock coupled thereto, said nock having a protuberance thereon with a cam surface facing the forward tip of said arrow; and a release mechanism including a central body member having a hand grasping portion, a pair of opposed jaws, each having a recess on facing sides thereof, the forward portion of each recess being in the form of a cam follower surface corresponding to part of the cam surface on said nock, means for pivotally mounting said jaws to said body member, means for biasing said opposed jaws towards each other into a grasping position in which the cam surface portion of said arrow nock contacts the cam follower surfaces of said recesses, locking means for locking said jaws together in the grasping position thereby locking said arrow nock protuberance between said jaws, and manually activated means, coupled to said locking means, for releasing said locking means thereby allowing said nock cam surface to move forward along said cam follower surfaces under the influence of the bowstring pulling on said nock so said jaws are pivoted outwardly of the grasping position by the moving nock cam surface, thereby releasing said nock and arrow therefrom.

16. The combination according to claim 14 wherein said recesses are each hemispherical, and said protuberance received in said recesses is substantially spherical thereby providing a universal coupling between said protuberance on said nock and said recesses in said jaws.

* * * * *

UNITED STATES PATENT AND TRADEMARK OFFICE

CERTIFICATE OF CORRECTION

PATENT NO. : 4,151,825

DATED : May 1, 1979

INVENTOR(S) : Thomas H. Cook

It is certified that error appears in the above–identified patent and that said Letters Patent are hereby corrected as shown below:

In claim 16, line 1, change "14" to --15--.

Signed and Sealed this

*Seventeenth* . Day of *July 1979*

[SEAL]

*Attest:*

*Attesting Officer*

LUTRELLE F. PARKER

*Acting Commissioner of Patents and Trademarks*